US005121664A

United States Patent [19]

Buenzli et al.

[11] Patent Number: 5,121,664

[45] Date of Patent: Jun. 16, 1992

[54] FORMING OF PROTECTIVE STRIPS ON PAPER CUTTING MACHINES

[75] Inventors: Paul Buenzli, Altendorf, Switzerland; Wolfgang Mohr, Hofheim, Fed. Rep. of Germany

[73] Assignee: Polatech GmbH, Altendorf, Switzerland

[21] Appl. No.: 628,698

[22] Filed: Dec. 14, 1990

Related U.S. Application Data

[63] Continuation-in-part of Ser. No. 392,939, Nov. 3, 1988, abandoned.

[30] Foreign Application Priority Data

Nov. 20, 1987 [CH] Switzerland ..... 04528/87

[51] Int. Cl.[5] ..... B26D 7/20

[52] U.S. Cl. ..... 83/658; 83/698

[58] Field of Search ..... 83/698, 659, 658; 403/357, 294, 225; 52/213, 214

[56] References Cited

U.S. PATENT DOCUMENTS

| | | | |
|---|---|---|---|
| 847,161 | 3/1907 | Clark | 83/659 X |
| 1,148,337 | 7/1915 | Schmidt | 83/659 |
| 1,350,399 | 8/1920 | Wilson | 52/213 |
| 2,281,877 | 5/1942 | Green | 83/658 |
| 2,680,484 | 6/1954 | Stuck | 83/659 X |
| 3,040,389 | 6/1962 | Fengler | 52/214 X |
| 3,046,824 | 7/1962 | Mohr | 83/698 X |
| 3,078,119 | 2/1963 | Premi et al. | 52/214 X |
| 4,661,008 | 4/1987 | Norihiro | 403/294 |

*Primary Examiner*—Frank T. Yost
*Assistant Examiner*—Rinaldi Rada
*Attorney, Agent, or Firm*—Wegner, Cantor, Mueller & Player

[57] ABSTRACT

The invention relates to a plastic strip, which prevents the blade of a paper cutting machine from touching the panel of the work surface. The latter is thus protected from damage. The specific shape of the strip makes it possible to produce the strip of polypropylene or a similar material by means of an extruder without any form of subsequent treatment. The strip is pushed into the groove already present in normal work surface panels. It has almost the same rectangular cross-section as the groove. On each of the two narrow side surfaces (1) of the strip, two longitudinal bulges (3) cause the strip to be somewhat broader than the groove and thus to be squashed together laterally when being pressed in, without the thickness being altered. The deformability necessary for this is achieved by two cavities (2) inside the strip along the narrow side surfaces (1).

14 Claims, 1 Drawing Sheet

FORMING OF PROTECTIVE STRIPS ON PAPER CUTTING MACHINES

This application is a continuation-in-part of U.S. Ser. No. 07/392,939, filed Nov. 3, 1988, now abandoned.

In cutting machines, the paper, which lies on a working surface mainly made of metal, is cut by a dropping blade. So that the blade and the surface are not damaged, there must be preventive measures taken to prevent the blade from making contact with the surface after cutting through the paper. Up to now, the problem has been solved as follows.

At the point where the blade would touch the table, the table was provided with a groove, about 10 mm long and 4.5 mm deep, into which a plastic strip was inserted. Up to now, there have been two different types of plastic protective strips. The strips of the first kind were snake-shaped or, to put it more precisely, sinus-shaped. When being pushed into the groove, the snake shape was forced into a straight line, whereby pressing forces were exerted on to both sides of the groove. These strips have decisive disadvantages. The strips are prone to wear. They must be thrown away after the blades have been changed four times. As they were produced of PVC, this meant a great deal of environmental pollution through PVC waste. As environmental damage from hydrochloric acid vapors is caused by the burning of PVC, the use of PVC in the packaging industry has been forbidden in Switzerland and since Nov. 1, 1990. It is to be expected that the ban will also be extended to other materials in the near future.

These strips had the further disadvantage that they required subsequent treatment on a special grinding machine (4-surface treatment) in their production by milling or grinding. In addition, the protective strips had to be given the required sinus shape in a heating furnace followed by cooling and cutting. During the subsequent treatment, small, hard particles of the grinding disk remained on the surface of the protective strip and later damaged the blade in the cutting process.

A further disadvantage is the fact that the PVC is too hard. The protective strips could only be pushed into the groove by hand with great effort. A hammer always had to be used to insert the strips, which destroyed the edges of the groove, meaning that the joint between the work surface and the strip was interrupted by indentations. When a pile of paper was pushed back and forth on the work surface, the bottom sheets permanently got caught, making speedy work impossible. It is in fact possible to reduce the hardness of the PVC with plasticizers, but PVC containing plasticizers shrinks in the course of time, as the plasticizers decompose. Protective strips of such material would therefore become useless after long-term storage.

The protective strips of the second kind consisted practically only of a thin film with a hose-like formation in the middle. The applicants for this patent are also the inventors of these protective strips, the patent CH 673 805 A5 being granted on Apr. 12, 1990, and the invention being disclosed in U.S. Ser. No. 07/392,939, herein incorporated by reference. So that this protective strip could be inserted into the grooves of existing paper cutting machines, a metal strip was glued into the existing groove. The metal strip had a ridge or recess in the middle, shaped in such a way that the protective strip with the hose-like formation could be pressed in. Owing to the specific shape of the ridge, a snap effect was achieved, which made simple insertion and extraction of the protective strip possible. Other forms of strips able to achieve a certain snap effect were also possible. PVC was no longer used as a material, but impact-resistant plastics such as polypropylene of high-molecular polyethylene were employed. This made it possible to produce the protective strips with a specific Shore hardness which was suitable for all know blades. This hardness cannot be achieved with PVC without problems, as it is between the hardness of soft and hard PVC and would therefore require the use of plasticizers with the above mentioned disadvantages. In the production of the second kind of strip, no kind of subsequent treatment was necessary any more. It was possible to dispense with the disadvantageous grinding. The cutting strips now merely had to be extruded by means of a corresponding extruder. This achieved a good surface quality. It was, however, shown that production of such complicated shapes as in the second kind of protective strips was very difficult if polypropylene is used. The reason for this is that polypropylene shows very strong adhesion in the mold.

The present invention provides a protective strip which has such a form that production with polypropylene or a similar material is easy to execute by means of an extruder.

The task is solved by the invention according to features of claim 1.

Figure 1:
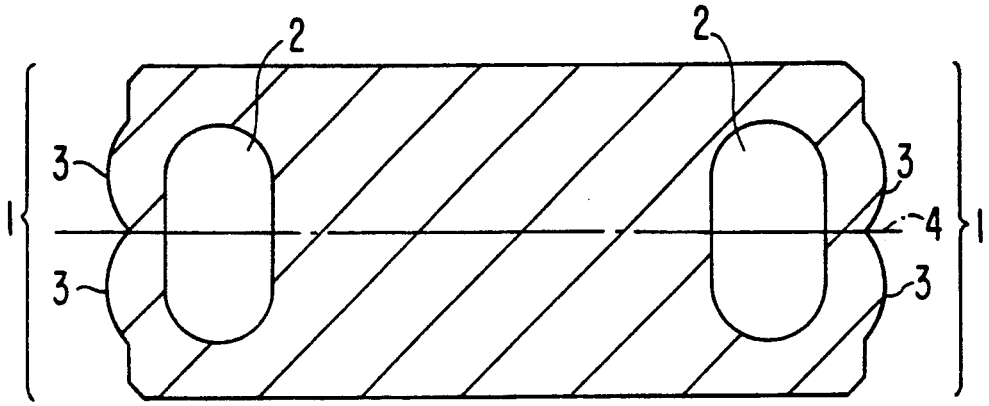
FIG. 1 Cross-sectional view through the protective strip
Figure 2:
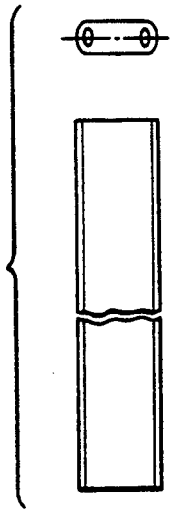
FIG. 2 Top view of the protective strip
Figure 3:
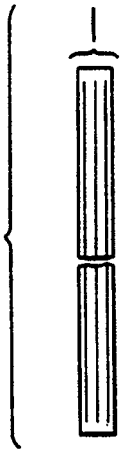
FIG. 3 Side view of the protective strip

The cross-section of the new protective strip corresponds roughly to a rectangle with a height of 4.5 mm and a length of 9.93 mm. Along each of the two narrow side surfaces 1, there is a cavity 2 on the inside of the protective strip. The cross-section of the cavity 2 can be seen from FIG. 1. The two thin side surfaces 1 are not planar. Two bulges 3 with a cross-sectional shape of a segment of a circle run in a longitudinal direction on the side surfaces 1. The bulges 3 are arranged symmetrical to the bisectors 4 of the thin sides 1. Including the height of the bulge, the length of the protective strip is a few tenths of a millimeter more than 10 mm and is thus somewhat longer than the groove in which it is to be inserted. When the protective strip is inserted into the groove, the thin side walls 1 can be pushed inwardly owing to the longitudinal cavities 2, without altering the thickness of the strip. Due to the elasticity of the polypropylene of which the protective strip is produced, the pressed-in side walls 1 exert a counterpressure on the walls of the groove via the longitudinal bulges 3, this counterpressure causing the protective strip to stay fixed in the groove. The height of the protective strip is some millimeters smaller than the height of the groove. This means that the protective strip does not protrude above the work surface even in cases of alterations in size caused by temperature deviations and changes in the relative humidity of the air. The alterations in size through changes of temperature and humidity have been taken into consideration in the forming, as polypropylene has a considerably higher coefficient of expansion than the metals of which the work surfaces are produced.

In this invention, it has been possible to maintain the advantages of the protective strips of the second kind discussed above and to achieve two further important advantages.

Due to its simple shape, the strip can be produced more easily of polypropylene or a similar material by means of an extruder. Polypropylene makes it possible not to have to offer a number of protective strips with various hardnesses. One protective strip with a Shore hardness to match all known types of blades is sufficient. The polypropylene waste can be disposed of without pollution to the environment. In the production of the new protective strip, no kind of subsequent treatment is necessary any more. The protective strip is merely extruded. This guarantees a high surface quality. The surface is no longer contaminated with hard grinder particles which could damage the blade.

The new protective strip can be pressed directly into the existing groove without an additional metal strip having to be glued into the groove beforehand.

Owing to the elasticity and the softness of the polypropylene and the special form of the new protective strip, the latter can be pressed into the groove easily by hand and be removed from the groove just as easily, which means that a hammer is no longer necessary for insertion. There will be no more destruction of the edges of the grooves and consequently nor more sheets of paper getting caught when the piles of paper are pushed back and forth.

Despite the relative softness of the materials, the new protective strips remains in the groove well, as the clamping pressure is active on the entire length of the protective strip and not only at individual points, as had been the case with the snake-shaped PVC protective strips of the first kind.

As the complicated subsequent treatment necessary for the protective strips of the first kind is no longer necessary, the costs of production are considerably lower.

What is claimed is:

1. A protective strip for removable insertion into a groove in the work surface of a paper cutting machine comprising a deformable strip of plastic having a longitudinal bead along each of two opposed lateral edges of said strip for contacting two opposed walls of the groove and a corresponding deformable cavity formed longitudinally within the strip near each of said two opposed edges and along said longitudinal beads, said deformable cavities thereby defining a pair of spaced-apart hollow portions with said strip, and wherein a cross-sectional shape of said strip substantially corresponds to a rectangle with said beads extending from two opposed sides of the rectangle.

2. The protective strip of claim 1, wherein each of said two opposed edges of said strip comprises first and second longitudinal beads.

3. The protective strip of claim 2, wherein said longitudinal beads have an arcuate cross-sectional shape.

4. The protective strip of claim 3, wherein said first and second longitudinal beads are symmetrical along a longitudinal bisector of said opposed edges.

5. The protective strip of claim 3, wherein said strip is composed of extruded polypropylene.

6. The protective strip of claim 2, wherein said first and second longitudinal beads are symmetrical along a longitudinal bisector of said opposed edges.

7. The protective strip of claim 6, wherein said strip is composed of extruded polypropylene.

8. The protective strip of claim 2, wherein said strip is composed of extruded polypropylene.

9. The protective strip of claim 1, wherein a length of said strip including said longitudinal beads is several tenths of a millimeter larger than a length of said groove.

10. The protective strip of claim 9, wherein said strip has a height of 4.45 mm for insertion into a groove having a depth of about 4.5 mm.

11. The protective strip of claim 1, wherein said strip is composed of extruded polypropylene.

12. The protective strip of claim 1, wherein a height of said strip is several tenths of a millimeter smaller than a depth of said groove and the length of said strip is several tenths of a millimeter more than a length of said groove.

13. A protective strip for removable insertion into a groove in the work surface of a paper cutting machine comprising a deformable strip of plastic having a longitudinal projection along each of two opposed sides of said strip for contacting two opposed walls of the groove and a corresponding deformable cavity formed within the strip along each of said longitudinal projections, wherein a cross-sectional shape of said strip substantially corresponds to a rectangle with said projections extending from two opposed sides of the rectangle, wherein a height of said strip is several tenths of a millimeter smaller than a depth of said groove.

14. The protective strip of claim 13, wherein said strip has a height of 4.45 mm for insertion into a groove having a depth of about 4.5 mm.

* * * * *